US005435008A

United States Patent [19]

Shane

[11] Patent Number: 5,435,008

[45] Date of Patent: Jul. 25, 1995

[54] ATHLETIC HAND GLOVE WITH COLLAPSIBLE GLOVE POCKET ASSEMBLY AND METHOD

[76] Inventor: David B. Shane, 2112 Asbury Ave., Evanston, Ill. 60201

[21] Appl. No.: 94,844

[22] Filed: Jul. 20, 1993

[51] Int. Cl.[6] ..... A41D 13/08

[52] U.S. Cl. ..... 2/16; 2/19; 2/161.1

[58] Field of Search ..... 2/16, 19, 20, 159, 161.1, 2/18, 160

[56] References Cited

U.S. PATENT DOCUMENTS

| | | | |
|---|---|---|---|
| 3,098,234 | 7/1963 | Latina | 2/19 |
| 3,602,915 | 9/1971 | Collins | 2/19 |
| 4,677,698 | 7/1987 | Angas | 2/19 |
| 4,700,404 | 10/1987 | Lespérance | 2/16 |
| 4,967,418 | 11/1990 | Marcotte | 2/16 |
| 5,113,530 | 5/1992 | Smith | 2/16 |
| 5,155,864 | 10/1992 | Walker et al. | 2/19 |

*Primary Examiner*—Clifford D. Crowder
*Assistant Examiner*—Larry D. Worrell, Jr.
*Attorney, Agent, or Firm*—Potthast & Ring

[57] ABSTRACT

An athletic hand glove 20 having a thumb portion 22 for receipt of a thumb of a user and a finger portion 26 for receipt of a plurality of fingers 28 from a hand 30 of the user, a collapsible glove pocket assembly 32 with a pocket member 34 moveable between a collapsed position for receipt and firm grasp of a playing stick 25 and a deployed position for catching a propelled object, the pocket member 34 is disposed between the thumb portion 22 and the finger portion 26 of the hand glove 20, the collapsible glove pocket assembly 32 connected to hand glove 20 enables the pocket member 34 to move from a collapsed to a deployed position.

30 Claims, 7 Drawing Sheets

ATHLETIC HAND GLOVE WITH COLLAPSIBLE GLOVE POCKET ASSEMBLY AND METHOD

BACKGROUND OF THE INVENTION

1. Field of the Invention

This invention relates generally to the field of athletic hand gloves and more particularly to goalie hand gloves used in the sports of ice hockey, field hockey, floor hockey and in-line skating hockey.

2. Description of the Related Art Including Information Disclosed Under 37 CFR 1.97–1.99

Athletic gloves worn for the protection of the user's hands or for catching propelled objects in various sporting activities are well known. Typically, in certain sporting activities such as ice hockey, field hockey, floor hockey and in-line skating hockey the primary objective of a goalkeeper is to prevent the passage of an object shot by the opposing team from entering into a goal. In one hand the goalkeeper carries a stick which is used for blocking of a shot object, such as a puck or a ball. Furthermore, the goalkeeper also uses his stick to pass the puck or ball to a teammate or to shoot the object into a particular area on the playing surface away from the opposition. The goalkeeper wears on his other hand a special type of glove, commonly called a mitt, for catching a flying puck or ball, thereby preventing it from entering the goal. Mitts have a small thumb pocket, a large finger pocket and a webbing or catching pocket area disposed therebetween.

Even though these known goalkeeper mitts provide a satisfactory means for catching a propelled object, their shape makes it extremely difficult to obtain a strong grip on the stick when passing or shooting the object such as a puck or ball or the like. Disadvantageously, the goalkeeper is not able to make controlled passes to teammates. Moreover, since the goalkeeper has a poor grip on the stick, the goalkeeper can shoot the object with only a small amount of force. This generally limits the goalkeeper to making only short passes and thus effects the goalkeeper's ability to clear the object far away from the goal when under attack from the opposing team. Additionally, the goalkeeper generally plays an insignificant part in his or her team's offense since he or she is unable to make controlled passes over a long distance.

Attempts have been made to improve the goalkeeper's ability to obtain a firm grip on the stick. In U.S. Pat. No. 4,967,418 to Marcotte, a hockey goalkeeper glove has a gripping portion placed on the outside of the glove to enable the goalkeeper to grasp the handle of a goalie stick. If the goalkeeper desires to grip the stick, in Martorre, he or she must remove his or her fingers from a finger pocket and insert them through an opening into a gripping pocket. The stick must be inserted between the collapsed finger pocket when attempting to control the stick. The goalkeeper must move his or her fingers again through the opening upon return to catching position. Disadvantageously, in Martorre the goalkeeper could have great difficulty in attempting to make a save with the glove if his or her hand is located outside the glove in the grasping pocket. Moreover, the stick cannot be instantly grasped since the goalkeeper must take the time to reposition his or her fingers into remote compartments. Furthermore, in Marcotte, the stick is held near the tips of the fingers and thumb and not in the palm of the goalkeeper's hand, thereby providing only a modest grasp of the stick.

Extension pouches are known to be on the glove of a goalkeeper which enhance the catching capabilities and trapping capabilities of the goalkeeper. These known extension pouches form an increased catching surface area of the glove since the extension pouch is an expanded region of the webbing. Generally, the extension pouch expands slightly upwardly and outwardly from the catching region in a hooked or curved manner thereby reaching a top point in order to maximize the catching coverage. Additionally, the slightly angled configuration of the extension pouch enables the puck or ball to be entirely encased when it is trapped on the playing surface by the goalkeeper. However, none of these conventional goalkeeper gloves are known to have a means for moving the extension pouch from a collapsed to a fully deployed position. Disadvantageously, by not being in a fully expanded or deployed position, the glove will not be able to cover the maximum catching region. When the extension pouch is deployed, the goalkeeper's ability to catch and trap is enhanced. When the extension pouch is in a collapsed position, the goalkeeper's ability to grasp a game stick is enhanced.

SUMMARY OF THE INVENTION

It is therefore a principal object of the invention to provide an athletic hand glove which enables the user to obtain a firm grip on a playing stick.

It is also an object of the present invention to provide an athletic hand glove which allows the user to make controlled passes with a stick over long distances.

It is an object of the present invention to provide an athletic hand glove which is specially shaped to adequately catch propelled playing objects and further enables the user of the glove to obtain a firm grip on the stick without having to reposition the fingers or thumb into different pockets of the glove.

The object is achieved by providing an athletic hand glove having a thumb portion for receipt of a thumb of a user and a finger portion for receipt of a plurality of fingers from a hand of the user, a collapsible glove pocket assembly having a pocket member disposed between the thumb portion and the finger portion and means connected to the hand glove for enabling a portion of the pocket member to move between a collapsed and a deployed position.

The objective is also achieved by providing such an athletic hand glove with a method of grasping the stick with the athletic hand glove comprising the steps of inserting the stick into the catching portion of the hand glove and collapsing a moveable section of the catching portion in response to the insertion of the stick.

The objective is also achieved by providing such an athletic hand glove having a thumb portion for receipt of a thumb of a user and a finger portion for receipt of a plurality of fingers from the hand of a user, a collapsible glove pocket assembly having a pocket member disposed between the thumb portion and the finger portion, an extension pouch connected to the pocket member and means for moving the extension pouch from a collapsed to a fully deployed position.

BRIEF DESCRIPTION OF THE DRAWING

The foregoing objects and advantageous features of the invention will be explained in greater detail and others will be made apparent from the detailed description of the preferred embodiment of the present invention which is given reference to the several figures of the drawing, in which.

DESCRIPTION OF THE PREFERRED EMBODIMENT

Figure 1:
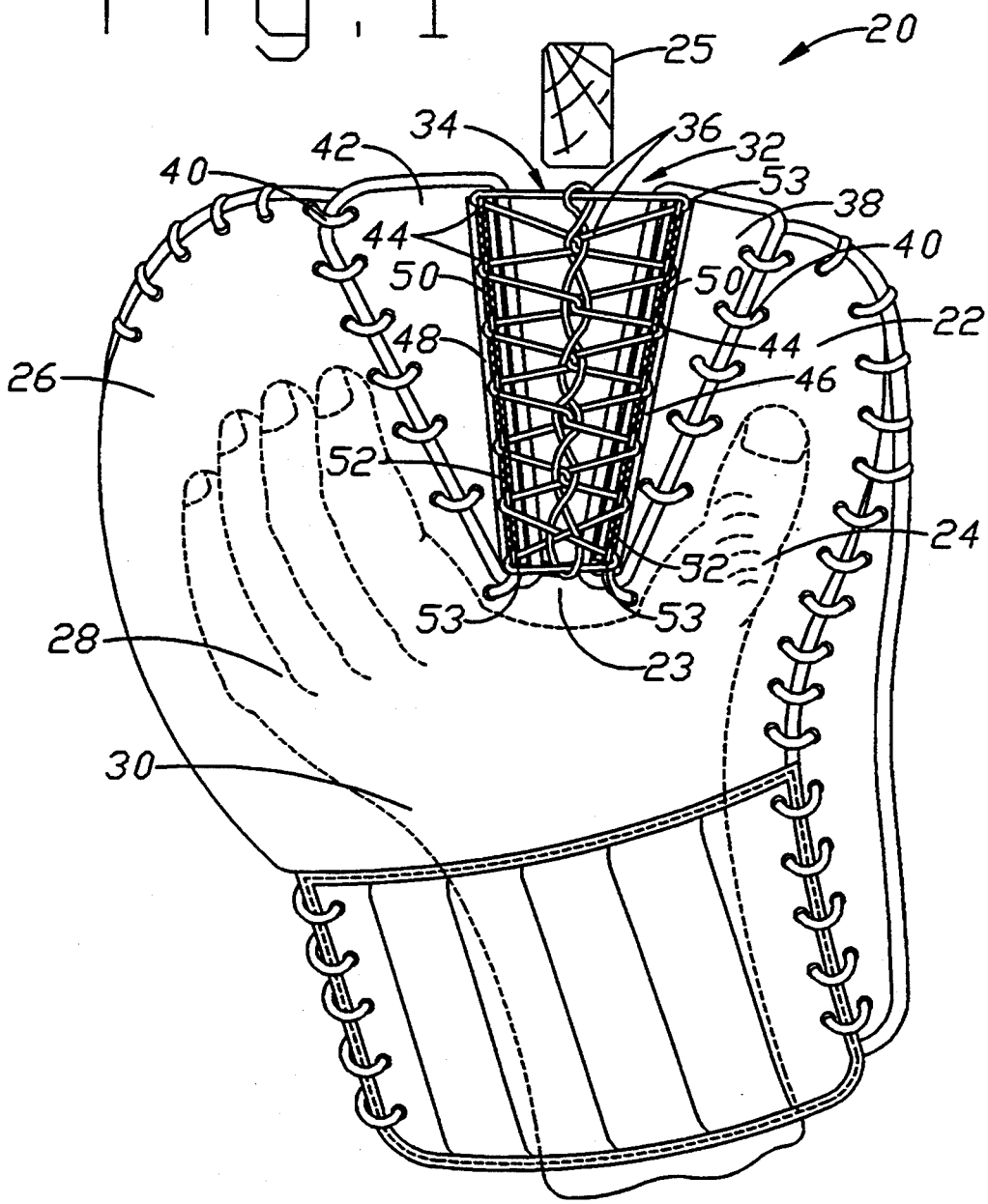
FIG. 1 is a back perspective view of the athletic hand glove with the glove pocket assembly fully deployed.

Referring to FIG. 1, athletic hand glove 20 is shown in the deployed position with thumb portion 22 covering the received thumb 24 of the user. The glove also has finger portion 26 which receives the remaining plurality of fingers 28 of the hand 30 of the user. Finger portion 26 and thumb portion 22 of glove 20 preferably completely cover fingers 28 and thumb 24 of the user to protect the hand 30 of the user against fast moving objects such as a puck or a ball which are caught by the user in the glove and against moving sticks of opposing players. Base 23 is formed in glove 20 at a juncture between thumb 22 and finger portion 26.

FIG. 1 illustrates one embodiment of glove pocket assembly 32 in the deployed position. Glove pocket assembly 32 includes pocket member 34 is positioned in opening defined between thumb portion 22, base 23 and finger portion 26. Pocket member 34 is connected to glove 20. The pocket member 34 is positioned in the opening region of the hand glove 20 defined between the thumb portion 22 the finger portion 26 and a base portion 23 which is formed at the juncture between the thumb and finger portions. Pocket member 34 has web structure 36 which defines a weave having interlacing members in which the openings in the interlacing members of the weave are smaller than the dimension of an object such as a puck or a ball to be caught by the glove. Therefore, a propelled playing object will not pass through the pocket member when the user attempts to catch the object. Pocket panel 38 is shown secured to thumb portion 22 by lacing 40. Another pocket panel 42 is secured by lacing 40 to finger portion 26 of the hand glove 20. Pocket panels 38, 42 are preferably made of a flexible leather to enable relative ease of movement of pocket member 34 and should also be sufficiently strong to withstand the force of a shot puck or ball caught by the user in pocket member 34. Alternatively, pocket panels 38, 42 may be secured to thumb portion 22 and finger portion 26 by any suitable attachment means such as by being integrally formed to the finger and thumb portions.

Figure 2:
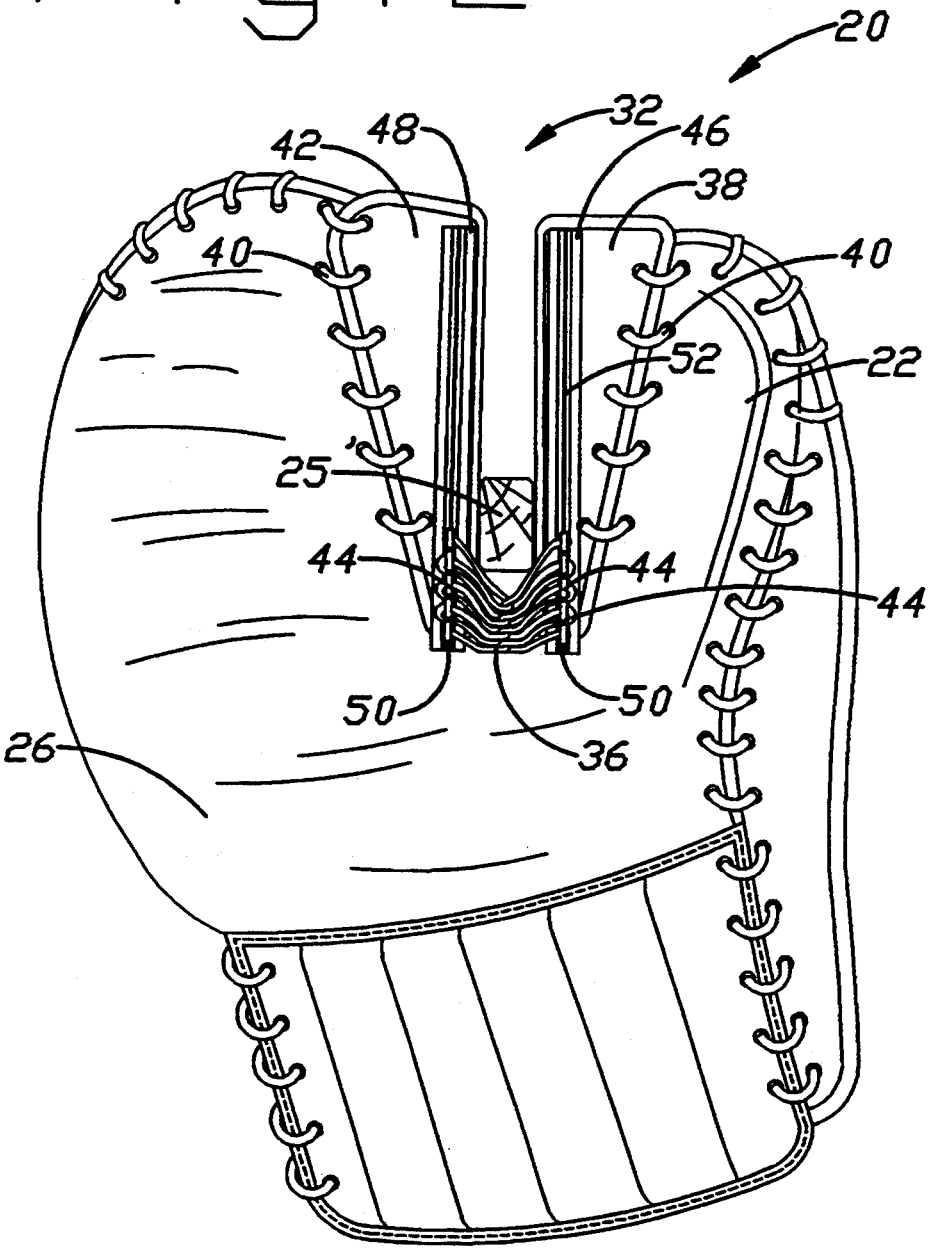
FIG. 2 is a back perspective view of the athletic hand glove of FIG. 1 with the glove pocket assembly collapsed.
Figure 5:
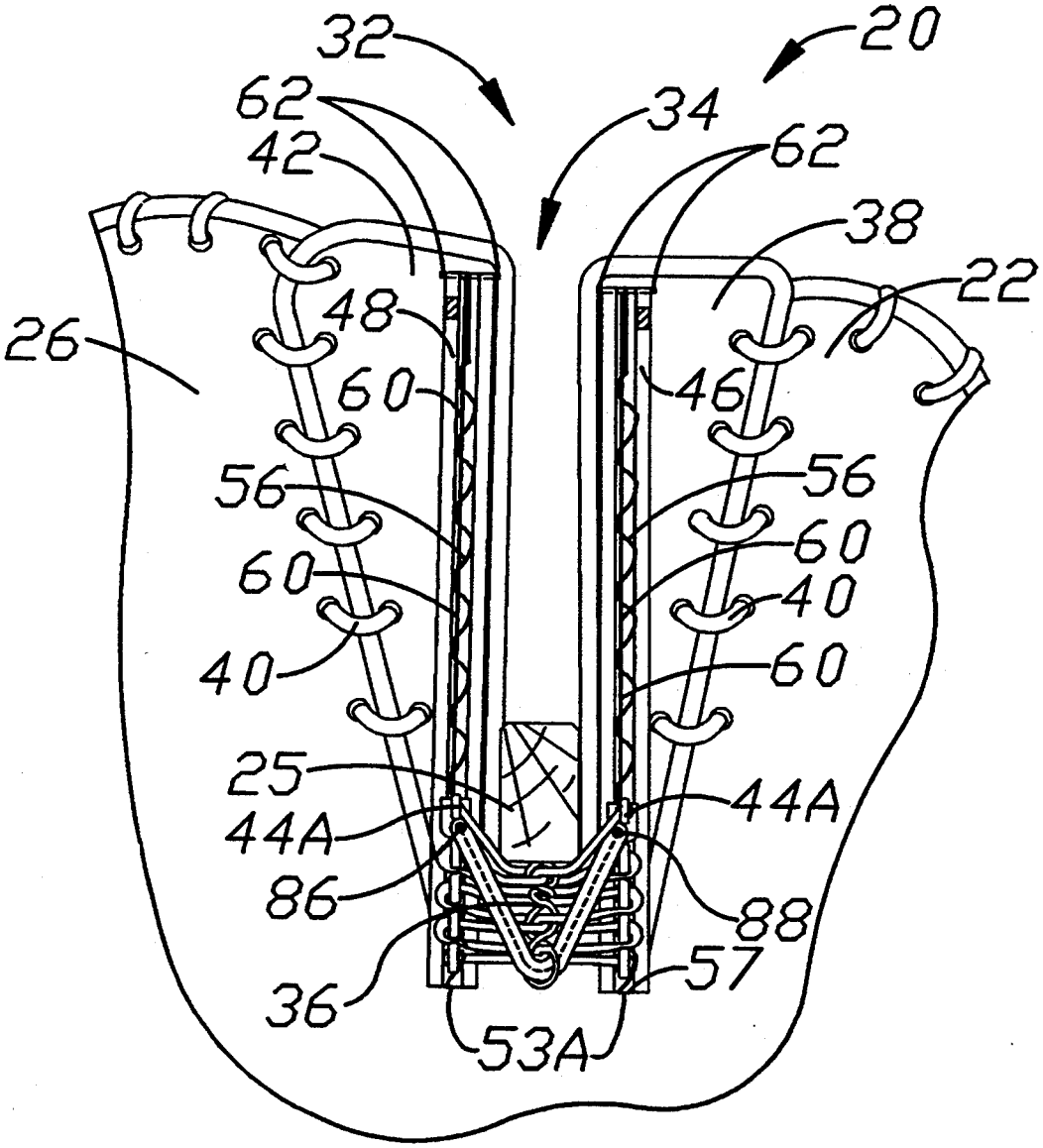
FIG. 5 is a partial back view of the athletic hand glove of FIG. 4 showing the glove pocket assembly with the extension pouch in the collapsed position.

Web structure 36 is secured to pocket panels 38 and 42 via a plurality of securement members 44 disposed within channeled tracks 46 and 48 attached to the panel members 38 and 42 respectively. Web structure 36 is preferably of a suitable flexible material such as leather strands to permit a certain degree of elasticity as game stick 25 engages webbing structure 36 upon the user or goalkeeper making the transition from the catching position as shown in FIG. 1 to the shooting position as shown in FIG. 2. It will be discussed in more detail below that a means connected to glove 20 is provided to enable at least a portion of pocket member 34 to move between a collapsed position, as seen in FIGS. 2 and 5, in which pocket member 34 is movable closer to base 23 independent of thumb portion 22 and finger portion 26 and a deployed position in which pocket member 34 is movable away from base 23. Webbing structure 36, FIG. 1, is laced through the individual loop openings of securement members 44, which are discussed in more detail below. In the embodiment shown in FIG. 1, a plurality of retention springs 50 disposed within channeled tracks 46, 48 are placed in abutment with the plurality of securement members 44. Supporting member 52, preferably an elongate metal wire or plastic bar, extends along the length of channeled regions of each track 46 and 48. Metal wire supporting member 52 is secured at the lengthwise ends 53 of channeled tracks 46, 48 and extends through a bore opening 70, FIGS. 6A and 6B, through the securement members 44 and through plurality of retention springs 50. The supporting member 52 acts to stabilize and support retention springs 50 disposed within the channels of tracks 46 and 48 to contain the spring within the channel and to provide smooth gliding movement of securement members 44 as they ride in the channeled track during transition from the deployed position as in FIG. 1 to the collapsed position as in FIG. 2.

Channeled tracks 46 and 48 are preferably made of a relatively flexible material in order to be able to conform to various straight or curved glove pocket configurations and positions. Additionally, channeled tracks 46 and 48 should be sufficiently strong to withstand the force of a fast moving propelled object to be caught in glove 20 and to protect the securement members 44 disposed therein. Preferably, a sufficiently strong yet flexible material such as Kevlar® is used for tracks 46 and 48, however alternative materials such as a flexible plastic or metal can also be used. Moreover, it is desirable to have the channeled tracks 46, 48 containing the securement member 44 angled or turned inward slightly toward each other in order to provide for smooth sliding movement of the securement members along the track as the glove pocket assembly 32 makes the transformation from the deployed or catching position, FIG. 1, to the collapsed or shooting position, FIG. 2.

Springs 50, FIG. 1, placed within channeled tracks 46 and 48 enable pocket member 34 to automatically and resiliently move between the collapsed position of FIG. 2 and the deployed or catching position of FIG. 1. Retention springs 50 in the embodiment shown in FIG. 1 act as biasing members in biasing influencing relationship with securement members 44 interconnecting web structure 36 is in one direction when in the deployed position, and also provide a restorative force to the securement member in an opposite direction when in the retracted or collapsed position as shown in FIG. 2. In the fully deployed position of FIG. 1 biasing members 50 are extended and provide a resilient force to securement members 44 in order to fully expand the webbing for optimal catching.

In response to the insertion of the playing or game stick 25, as seen in FIG. 2, the biasing members 50 compress and provide some resistant force as it is being compressed to thereby provide an effective restorative force to securement members 44 with the pocket member in a collapsed position. Stick 25 is now in proximity of being between the user's thumb and fingers providing the proper position for the user to more effectively grasp the stick and thereby more effectively utilize the stick. The user or goalkeeper is quickly and effectively able to make the transition from the catching mode, as illustrated in FIG. 1, to the passing or shooting mode shown in FIG. 2 without the time consuming need to reposition the fingers into remote compartments. Additionally, since the stick 25 is positioned at a location proximate "V" region near the base 23 of the pocket member 34 between the index finger and the thumb, the user is able to rotate the finger portion 26 of the glove 20 and obtain a firm grasp of the shaft of the stick 25 in the palm of the hand. By having the finger portion 26 and thumb portion 22 of the glove 20 firmly grasping the stick 25, the user or goalkeeper can make controlled passes or shots over a long distance. These advantages are not possible in conventional webbed hand gloves.

Upon removal of stick 25 from pocket member 34, the pocket member is instantly enabled to be automatically moved and restored to the fully deployed position as seen in FIG. 1 if the user is not in need to have grasping control over stick 25. Thus, the user is able to utilize the glove more effectively for the catching mode.

Figure 3:
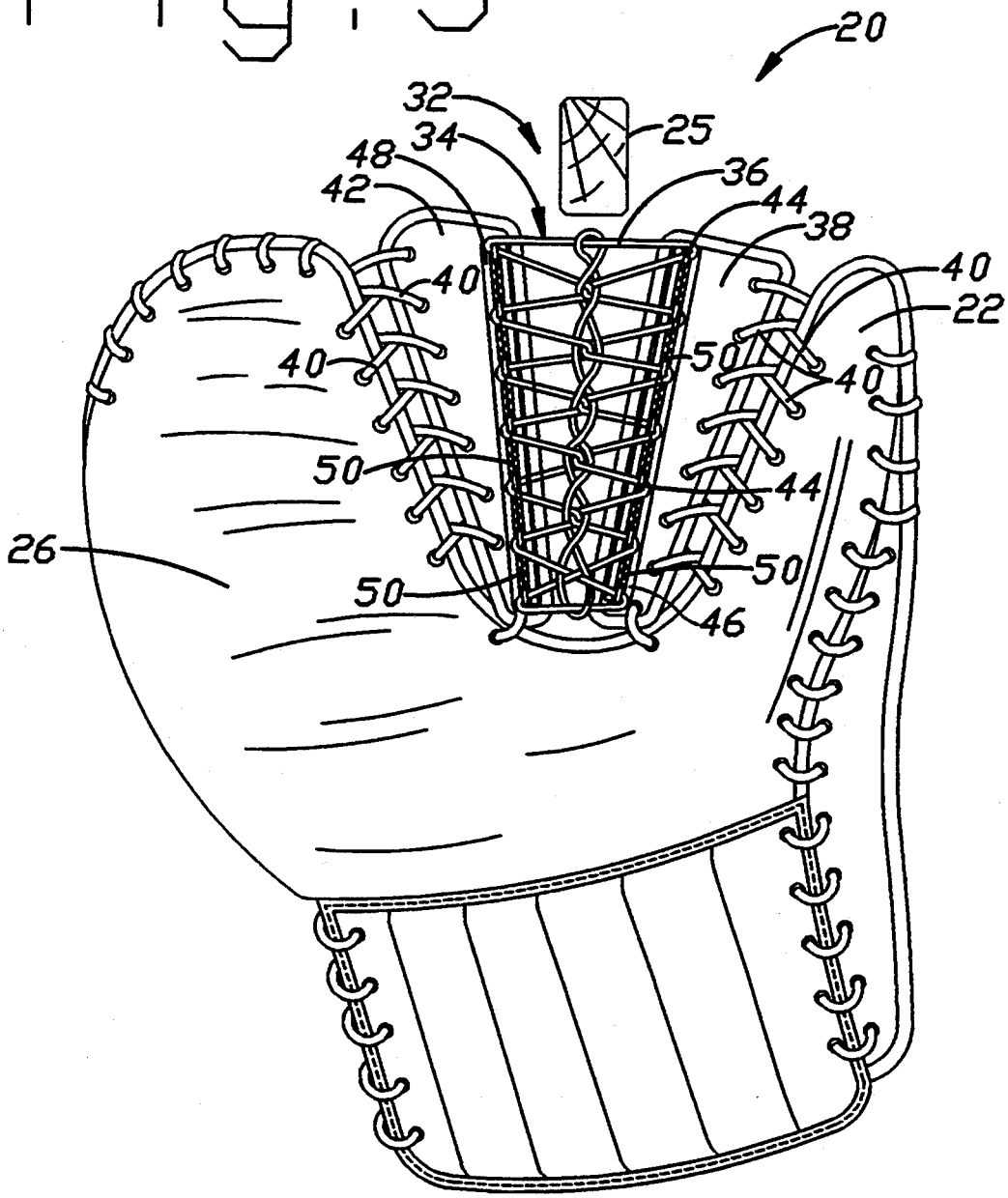
FIG. 3 is a back perspective view of the athletic hand glove of FIG. 1 illustrating additional webbing interconnecting the pocket panels to thumb and finger portions.

Referring now to FIG. 3, an alternative embodiment to athletic hand glove 20 in FIG. 1 is shown. In this embodiment glove 20 is given more flexibility and an extended catching area by having panels 38 and 42 secured to thumb and finger portions 22, 26 respectively by lace 40. Alternatively, the interconnection between the panels 38, 42 and the thumb portion 22 and finger portion 26 can be accomplished by means of a flexible webbing 36 similar to that shown in FIG. 1. Glove 20 will now have a more flexible closing capability.

Figure 4:
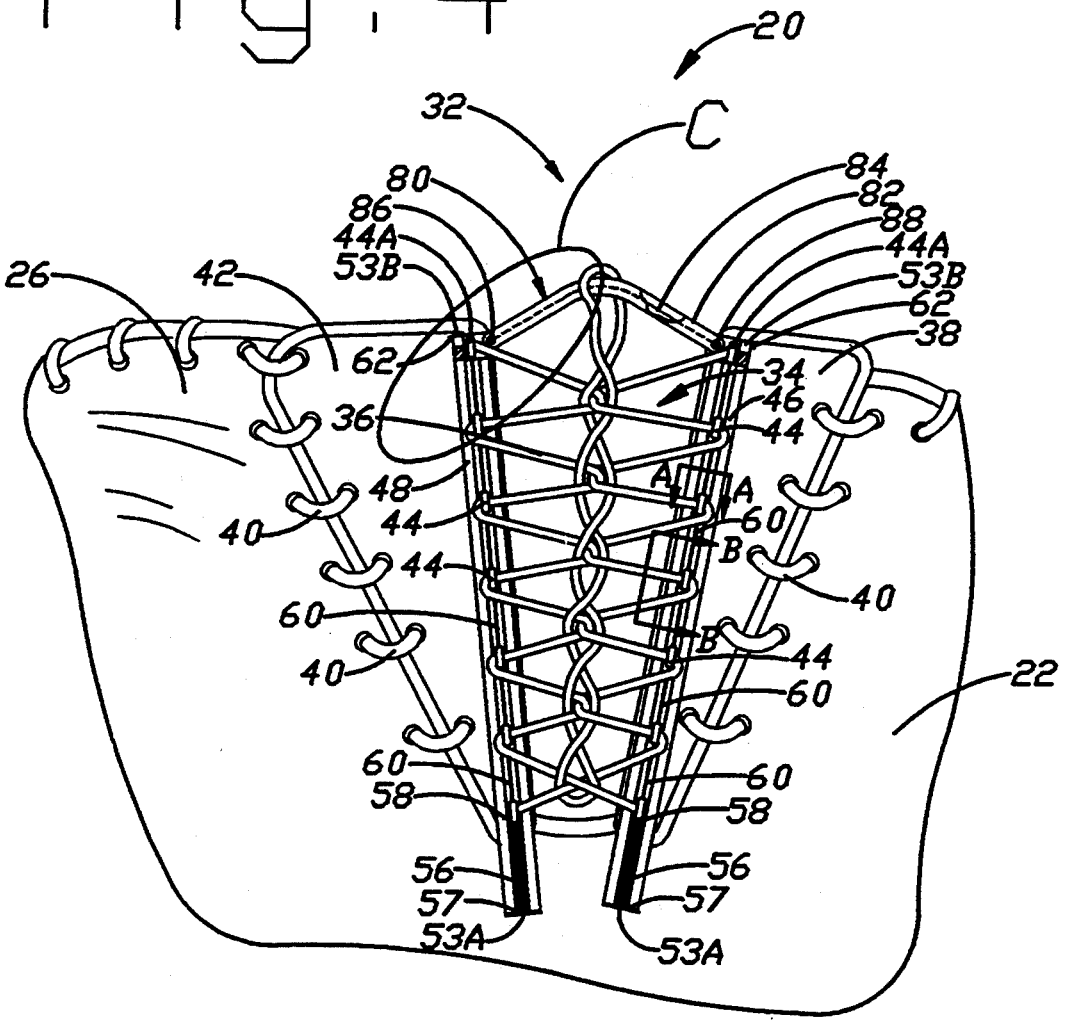
FIG. 4 is a partial back view of the athletic hand glove showing another embodiment of the glove pocket assembly with the extension pouch.

Referring to FIG. 4 another alternative embodiment of collapsible glove pocket assembly 32 is shown. As in the first embodiment, the alternative embodiment also has a pair of channeled track members 46 and 48 secured to pocket panels 38 and 42. In either embodiment channeled tracks 46, 48 are attached to panels 38, 42 by any suitable securing means such as stitching, riveting, heat molding, gluing or retrofitting the tracks to the panels. Alternatively, channeled tracks 46 and 48 could be attached directly to thumb portion 22 and finger portion 26 thereby extending flexible webbing structure 36 across the catching portion or pocket member area 34. Furthermore, the alternative embodiment of FIG. 4 has a plurality of securement members 44 having a portion disposed within the channeled tracks 46, 48 and a looped portion engaging webbing structure 36 which is discussed in more detail below. However, in the alternative embodiment a pair of biasing member extension springs 56 are placed within channeled region of the tracks 46, 48. As seen in FIG. 4 extension springs 56 are shown in the compressed position at bottom end 53A of tracks 46, 48 when athletic hand glove 20 is in the catching or deployed position. One end 57 of extension spring 56 is secured to bottom enclosed end 53A of the tracks 46, 48. Other end 58 of extension spring 56 is attached to a string member 60. The string member 60 is preferably a nylon cord, however any suitable string, rope, band or cord could also be employed. String member 60 extends through channeled tracks 46, 48 beneath securement members 44. String 60 engages a pivot member 62, as shown also in FIG. 5, which is an elongate bar extending across the top end 53B of each of the channeled tracks. String member 60 extends underneath top securement member 44A, as shown in more detail in FIGS. 7A and 7B. String member 60 additionally loops pivot member 62, is placed through a bore opening 63 in top securement member 44A and string member 60 is tied and secured at the opposing end 61 of securement member 44A, as shown in more detail in FIGS. 7A and 7B.

Referring now to FIG. 5, the embodiment of FIG. 4 is shown with stick 25 moved into pocket member 34 thereby collapsing flexible webbing 36. As webbing 36 collapses, the top securement member 44A exerts a force on string member 60 as securement member 44A moves down channeled tracks 46, 48. As string member 60 is pulled downwardly by securement member 44A, string member 60 which passes over pivot bar 62 and connects to the top portion of extension springs 56, pulls springs 56 upwardly and resiliently extending it. As the string members 60 are pulled by the downward movement of the top securement members 44A in response to the insertion of stick 25 into the pocket member 34, the extension springs 56 are expanded through the channeled tracks 46, 48 beneath the plurality of securement members 44. The stick 25 is positioned in the same manner as described for the embodiment shown in FIG. 2 and thus the user is enabled to quickly obtain a strong grip along the shaft of the same stick and make sharp accurate passes of the playing object. As shown in FIGS. 4 and 5 the channeled tracks 46, 48 are extended beyond the panel members 38, 42 to allow the elastic webbing 36 to retract as far as possible thereby positioning the stick 25 in a location proximate to the palm of the hand of the user. The further down in the pocket member region 34 the stick 25 is positioned the better the user is able to grasp and control the stick. Once stick 25 is removed from webbing 36, the spring members 56 move back to the deployed position as seen in FIG. 4 thereby pulling on string member 60 and raising webbing 36 to its catching mode. The securement members 44 return to their previous position along the tracks 46, 48 due to their tight interconnection with the webbing structure 36.

Figure 6B:
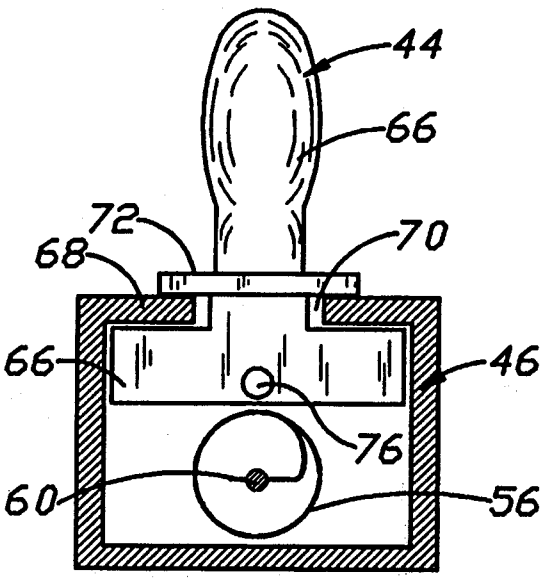
FIG. 6B is a side elevational view of a securement member and channeled track as is along line B—B of FIG. 4 without webbing.
Figure 6A:
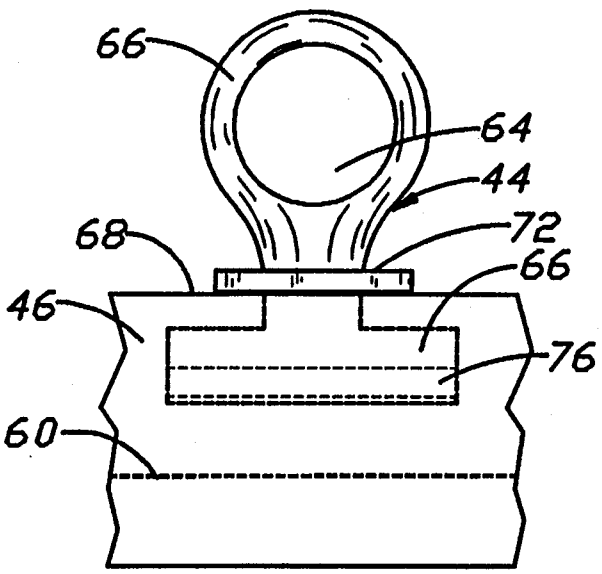
FIG. 6A is a cross sectional view of securement member and channeled track along A—A of FIG. 4 without webbing.

Now referring FIGS. 6A and 6B, securement member 44 has first portion or loop opening 64 through which the elastic webbing 36, FIGS. 1-5, of pocket member 34 passes through and is thereby secured to securement member 44. Securement member 44, FIGS. 6A and 6B, also has second portion 66 which is disposed in track 46 and has a body having a smaller dimension than the inside portion of track 46 and thereby is movably secured along track 46. Track 46 is generally U-shaped and has top portion 68 which reduces the dimension of opening 70 of track 46 and in which second portion 66 is larger in dimension than opening 70 thereby preventing securement member 44 from removal from track 46. Collar 72 attached to securement member 44 is disposed above opening 70 and has a wider dimension than opening 70. Thus, as securement member 44 runs along track 46 collar 72 maintains second portion 66 elevated within channel track 46 and provides securement member 44 stabilized movement over top portion 68 of track 46.

In viewing FIGS. 6A and 6B, in conjunction with the embodiment seen in FIG. 4, string member 60 extends below securement member 44 in track 46 and is secured to extension spring 56 at one end. Thus, when extension spring 56 is moved to an extended position as seen in FIG. 5, extension spring 56 also extends along track 46 and below second portion 66 of securement member 44. Bore 76 is preferably disposed in the second portion 66 of securement member 44 in the embodiment shown in FIG. 1. Bore 76 is utilized to engage retention springs 50, FIG. 1, to aid in maintaining the alignment of spring 50 with second portion 66 of the securement member 44. Further, bore 76, FIG. 6B, is utilized to carry supporting wire member 52, FIG. 1, which extends along the length of tracks 46, 48 and in which wire member 52 extends through the length of springs 50 and carries springs 50. Thus, retention springs 50 are maintained in alignment with second portion 66 of securement members 44 throughout tracks 46 and 48 by wire member 52 and keeping springs 50 from migrating out through the opening 70 of the channeled tracks 46, 48.

Now referring to FIGS. 4 and 5, another feature of the present invention includes extension pouch 80 having an outer portion 82 that preferably extends outwardly from the glove and within the outer portion is contained a resilient member 84. The resilient member 84 is preferably surrounded by a protectable material of canvass cloth or leather of the outer portion. Alternatively, the outer portion is a resilient member itself. Preferably the resilient member is a resilient flexible cord, wire form or body of numerous shapes composed of any number of commonly known plastics, metals or composite materials or the like. Outer portion 82 is connected to pocket portion or webbing 36 and has its ends 86, 88 rotatably connected to eccentric collar or cam 90 at an eccentric position on cam 90. Cam 90 is in turn rotatably connected to the top securement members 44A. In referring to FIG. 6A, which shows securement member 44, cam 90 is in a similar position as collar 70, however cam 90 is preferably of an eccentric shape and of larger dimensions as can be appreciated in FIG. 7A.

Figure 7A:
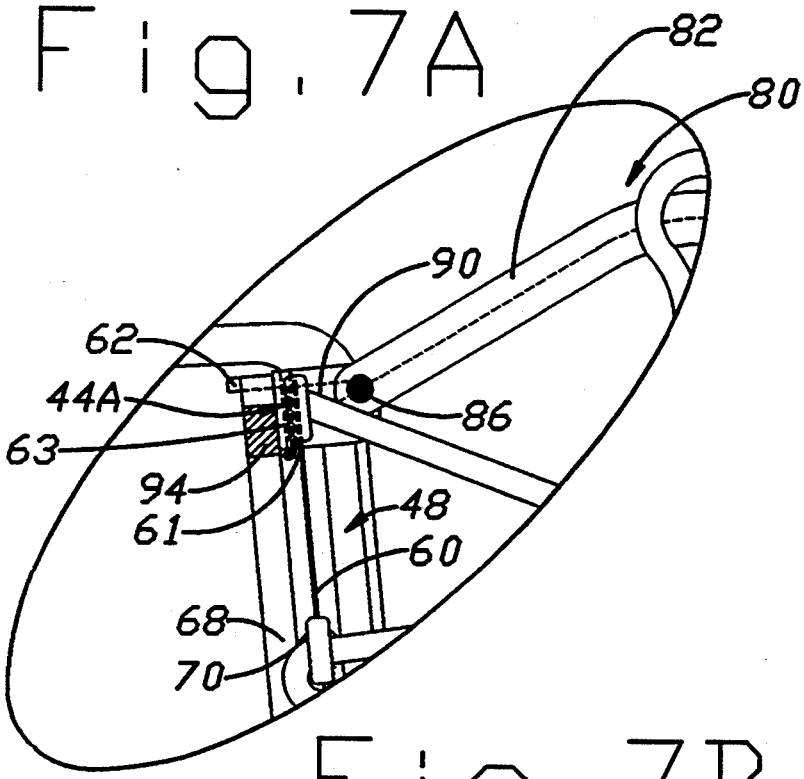
FIG. 7A is an enlarged top view of "C" as shown in FIG. 4 of the structure for moving the extension pouch with the extension pouch in a deployed position.

Thus, when outer portion 82 is in a deployed position as seen in FIG. 7A cam 90 has its flattened portion 92 abutting block member 94. Block member 94 is a raised portion extending upwardly from top portion 68 of track 48. At the time the user applies a force from a game stick 25, FIG. 5, to outer portion 82, outer portion 82 inverts begins to move toward the glove. Outer portion 82 via the elongate resilient member 84 begins to flex and continues to do so as the game stick 25 is moved inwardly toward the glove. At the same time, outer portion 82 exerts a force at its rotatable connection on cam 90. Cam 90 in turn pushes top securement member 44A down track 48. Once cam 90 passes block member 94, cam 90 begins to rotate and establishes a position as seen in FIG. 7B.

Figure 7B:
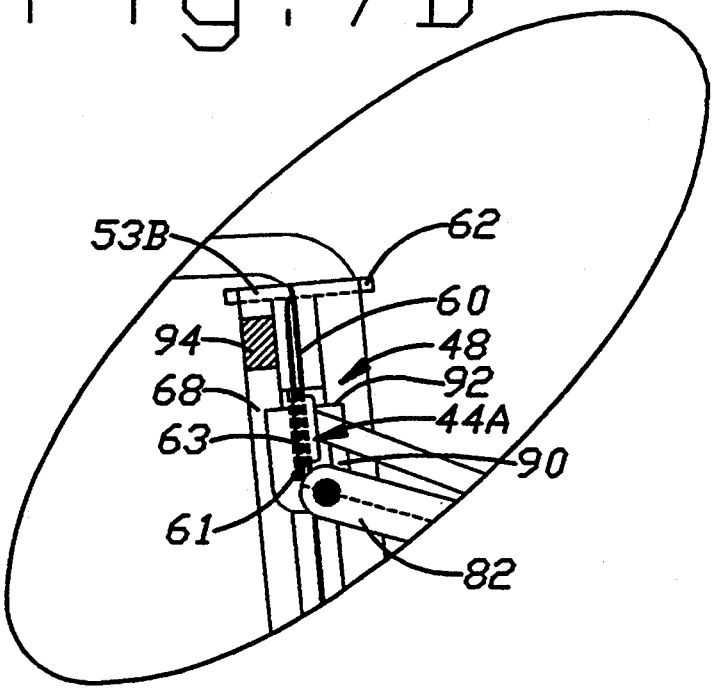
FIG. 7B is the view of the structure for moving the extension pouch of FIG. 7A with the extension pouch in a collapsed position.

As seen in FIG. 7B and FIG. 5 outer portion 82 inverts and collapses as securement member 44A carries outer member 82 to a lower position on track 48. Once the game stick 25 is desired to be removed, top securement member 44A moves upwardly along track 48 and when the flattened portion 92 of the rotatable cam 90 contacts block member 94 the cam 90 begins to rotate about securement member 44A. Because outer portion 82 is secured at an eccentric position on cam 90, a force is exerted onto outer portion 82 and outer portion 82 flexes into a deployed position. At the deployed position, the extension pouch 80 reaches a point at its top to give the user a greater catching surface area and provides the user with a more secure trapping structure.

While the advantages of the invention are preferably obtained with collapsible glove pocket assembly 32 described above with reference to FIGS. 1–7B, the method of the invention can be practiced in any other athletic hand glove for use by an individual with a game stick in which the athletic hand glove has a thumb portion, a base portion 23, a finger portion and a catching portion 34 catching portion 34 is positioned in opening defined between thumb portion 22, base portion 23 and finger portion 26 in which the catching portion includes a movable section and means for moving, as discussed earlier, the movable section from a deployed position in which the movable section is spaced away from the base portion, as seen for example in FIGS. 1 and 3, to a collapsed position in which the movable section is relatively closer to the base portion, as seen for example in FIGS. 2 and 5. In any event, the preferred method of practicing the invention comprises the steps of (1) placing the stick into contact with the movable section of the catching portion; and (2) pushing the stick against the movable section of the catching portion resulting in moving the movable section from the deployed position to the collapsed position. The movable section can be seen in FIGS. 1–3 and 5 being moved in typical deployed and collapsed positions. This method includes removing the stick from catching portion 34 in which the movable section, preferably including elastic webbing 36, is resiliently secured to the catching portion. Thus, when the movable section is collapsed or retracted the movable section exerts a resilient force in the opposite direction of the collapsing movable section. This resilient force preferably obtained by biasing spring members 50 or 56 will move the moveable section to a deployed position when the stick is removed from the catching portion.

While a detailed description of the preferred embodiment of the invention has been given, it should be appreciated that many variations can be made thereto without departing from the scope of the invention as set forth in the appended claims. For example, it is contemplated by the inventor that alternative variations could be employed by providing an athletic hand glove in which the entire pocket region between the thumb and finger portion collapses through the implementation of elastic webbing stretched into the thumb and finger pockets and extending across the entire pocket region therebetween. It is also contemplated that magnets or a mechanized movable track having an activator within the hand glove to automatically collapse and deploy the pocket member area could be used as alternative variations.

I claim:

1. In an athletic hand glove having a thumb portion for receipt of a thumb of a user and a finger portion for receipt of a plurality of fingers from a hand of the user and a base formed in the hand glove at a juncture between the thumb and finger portions, the improvement being a collapsible glove pocket assembly comprising:

a pocket member positioned in an opening defined between the thumb portion, the base and the finger portion and in which said pocket member is connected to said hand glove; and means connected to the hand glove for enabling at least a portion of the pocket member to move between a collapsed position in which said pocket member portion is movable closer to the base independent of said thumb and finger portions and a deployed position in which said pocket member portion is movable away from the base.

2. The athletic hand glove of claim 1 in which the pocket member includes a web structure.

3. The athletic hand glove of claim 2 in which the web structure defines a weave having interlacing members defining openings between the interlacing members in which said openings are smaller than the dimensions of an object to be caught by the glove.

4. The athletic hand glove of claim 2 in which the web structure is secured to a pocket panel and the pocket panel is attached to at least one of the thumb portion and finger portion and in which the pocket panel supports the enabling means.

5. The athletic hand glove of claim 4 in which said pocket panel is secured to at least one of the thumb portion and finger portion.

6. The athletic hand glove of claim 1 in which the enabling means includes means for securing and moving at least a portion of the pocket member relative to the finger portion of the glove.

7. The athletic hand glove of claim 6 in which the securing means includes a securement member which has a first portion to engage the pocket member and has a second portion movably secured within a channeled track.

8. The athletic hand glove of claim 7 in which the channeled track is secured to a pocket panel attached to one of at least the thumb portion and the finger portion.

9. The athletic hand glove of claim 7 in which the channeled track is generally U-shaped having opposing sidewalls and having a top portion to the channeled track which defines an opening having a dimension smaller than a distance between said opposing sidewalls on an inside of said channeled track.

10. The athletic hand glove of claim 9 in which the second portion of the securement member is disposed within the channeled track in which said second portion is of a dimension larger than the opening of the channeled track.

11. The athletic hand glove of claim 1 in which the enabling means includes means for resiliently moving at least a portion of the pocket member to a collapsed position and back to a deployed position.

12. The athletic hand glove of claim 11 in which the resiliently moving means includes an extension spring secured to the hand glove;

a channeled track secured to the hand glove, a securement member having a portion connected to the pocket member and another portion disposed within the channeled track, and a string member having a pair of opposed ends in which one opposed end is attached to the extension spring and another opposed end is connected to the securement means.

13. The athletic hand glove of claim 12 including a pivot member secured to the hand glove in which the pivot member engages the string member between the pair of opposed ends.

14. The athletic hand glove of claim 11 in which the resiliently moving means includes a biasing member in biasing influencing relationship with a securement member attached to the pocket member and in which the biasing member provides resistant force to the securement member for movement of the securement member in one direction and restorative force to the securement member in an opposite direction.

15. The athletic hand glove of claim 14 in which the biasing member is a retention spring in abutment with the securement member disposed within a channeled track secured to the glove.

16. The athletic hand glove of claim 14 in which the biasing member is a spring disposed within a channeled track secured to the glove.

17. The athletic hand glove of claim 16 in which the spring has a first position providing resilient force to the securement member which maintains the pocket member in a fully deployed position.

18. The athletic hand glove of claim 17 in which the spring member provides restorative force to the securement member with the pocket member in a collapsed position.

19. The athletic hand glove of claim 1 in which an extension pouch is connected to and disposed outwardly from the pocket member.

20. The athletic hand glove of claim 19 including means to enable the extension pouch to move from a collapsed to a fully deployed position.

21. In an athletic hand glove having a thumb portion for receipt of a thumb of a user and a finger portion for receipt of a plurality of fingers from the hand of the user and a base formed in the hand glove at a juncture between the thumb and finger portions, the improvement being a collapsible glove pocket assembly comprising:

a pocket member positioned in an opening defined between the thumb portion, the base and the finger portion in which said pocket member is connected to the hand glove and in which said pocket member extends outwardly in said opening to at least a distal portion of said thumb and finger portions;

an extension pouch connected to and extending outwardly from the pocket member; and means for moving the extension pouch from a collapsed position in which the extension pouch is relatively closer to the base and to a fully deployed position in which said extension pouch is moved relatively further from the base.

22. The athletic hand glove of claim 21 in which the extension pouch is positioned between the thumb portion and the finger portion and extends outwardly from the pocket member which includes a resilient member secured to the extension pouch biasing the extension pouch in said outwardly direction.

23. The athletic hand glove of claim 22 in which the means for moving is secured to the resilient member.

24. The athletic hand glove of claim 23 in which the means for moving includes a cam secured to the pocket member and connected with the resilient member to move the resilient member from a collapsed to a deployed position.

25. The athletic hand glove of claim 24 in which the means for moving includes means for rotating the cam connected to the glove.

26. The athletic hand glove of claim 25 in which the rotating means includes a biasing member mounted to the hand glove to move the cam member in relation to the rotating means.

27. In a method of grasping a stick with an athletic hand glove comprising the steps of:

providing a glove including a thumb portion, a base portion, a finger portion, and a catching portion; said catching portion positioned in an opening defined between the thumb portion, the base portion and the finger portion; said catching portion including a movable section and means for moving said movable section from a deployed position in which said movable section is spaced away from said base portion to a collapsed position in which said movable section is relatively closer to said base portion;

placing the stick into contact with the movable section of the catching portion;

pushing said stick against said movable section of the catching portion; thereby, moving said movable section from the deployed position to the collapsed position.

28. The method of claim 27 including the steps of: removing the stick from the catching portion.

29. The method of claim 27 in which the moveable section of the catching portion is resiliently secured to the catching portion.

30. The method of claim 27 in which the step of pushing the stick includes the moveable section exerting a resilient force in the opposite direction of the moveable section which automatically moves the moveable section into a fully deployed position upon removing the stick from the catching portion.

* * * * *